US006079054A

United States Patent [19]

Chou

[11] Patent Number: 6,079,054

[45] Date of Patent: Jun. 27, 2000

[54] INTEGRALLY FORMED SWIMMING GOGGLES

[76] Inventor: Terry Chou, No.12 Hsin Ho Herng Road, Tainan City, Taiwan

[21] Appl. No.: 09/344,236

[22] Filed: Jun. 25, 1999

[51] Int. Cl.[7] ..... A61F 9/02

[52] U.S. Cl. ..... 2/428; 2/445; 2/452

[58] Field of Search ..... 2/428, 430, 439, 2/452, 440, 445

[56] References Cited

U.S. PATENT DOCUMENTS

| | | | |
|---|---|---|---|
| 4,279,039 | 7/1981 | Drew | 2/428 |
| 5,706,526 | 1/1998 | Huang | 2/428 |
| 5,799,338 | 9/1998 | Huang | 2/428 |
| 5,802,621 | 9/1998 | Chou | 2/430 |
| 5,829,064 | 11/1998 | Huang | 2/428 |
| 5,873,134 | 2/1999 | Chou | 2/439 X |
| 5,896,589 | 4/1999 | Chou | 2/428 |
| 5,966,745 | 10/1999 | Schwartz et al. | 2/428 |

*Primary Examiner*—Peter Nerbun
*Attorney, Agent, or Firm*—Charles E Baxley, Esq.

[57] ABSTRACT

A pair of swimming goggles includes two lenses, two padding members, a bridge, and a strap. The lenses, the padding members, and the bridge are integrally formed by a material that is transparent and flexible. Each lens is formed with an end edge and a front face that are resistant to stretching. A connecting section is formed on the end edge of each lens for connecting with an end of the strap. Each padding member is annular and directly formed on an inner side of an associated lens. Each padding member has a thickness smaller than that of the front face of the associated lens and that of the end edge of the associated lens to provide resiliency.

3 Claims, 7 Drawing Sheets

INTEGRALLY FORMED SWIMMING GOGGLES

BACKGROUND OF THE INVENTION

1. Field of the Invention

The present invention relates to a pair of swimming goggles that is integrally formed to provide improved waterproof effect and safety.

2. Description of the Related Art

FIG. 6 of the drawings illustrates a pair of conventional swimming goggles that includes two lenses 1', two padding members 2', a bridge 3', and a strap 4'. The lens 1' is made of transparent rigid material. Each lens 1' includes a flange 11' for engaging with an associated padding member 2'. Each lens 1' further includes a first connecting section 12' on an inner edge thereof for engaging with an end of a bridge 3' and a second connection section 13' on an outer edge thereof for engaging with an end of the strap 4'. Each padding member 2' includes an engaging section 21' on an outer face thereof for engaging with the flange 11' of an associated lens 1' and a padding flange 22' in close contact with an eye socket of the user. Nevertheless, the lenses 1' and the bridge 3' are separate and thus fail to provide an aesthetically pleasing effect. In addition, the padding members 2' and the lenses 1' tend to disengage from each other after assembly if impinged by external force, thereby resulting in ingress of water into the swimming goggles. Furthermore, sharp corners of the rigid lenses 1' might cause injury to the user if the padding member 2' disengages from the lens 1'. The eyes of the user might be injured if the lens 1' breaks. A further drawback of the swimming goggles resides in that the lenses 1', the padding members 2', the bridge 3'. And the strap 4' are made of different material and thus cause difficulty in recycling.

FIGS. 5 and 6 illustrate another pair of conventional swimming goggles that includes two lenses 5', two frames 6', a bridge 7', and a strap 8'. The lens 5' is also made of transparent rigid material. Each lens 5' includes a connecting peripheral edge 51' for engaging with an associated frame 6'. The frames 6' and the bridge 7' are integrally formed by the same material. A padding section 61' is directly formed on an inner side of each frame 6' to be in close contact with the eye socket of the user. A connecting section 62' is directly formed on an end edge of each frame 6' for connecting with an end of the strap 8'. Each frame 6' further includes an annular groove 63' for receiving the peripheral edge 51' of an associated lens 5'. The frame 6' and the lens 5' are bonded together by gluing or any other suitable means. Since the lens 5' and the frame 6' are made of different material, the annular groove 63' of the frame 6' and the peripheral edge 51' of the lens 5' cannot provide a water-proof effect (see gap "a" in FIGS. 7 and 8) when the strap 8' is pulled for wearing. As a result, ingress of water into the swimming goggles occurs. In addition, the view of the user wearing the pair of swimming goggles is poor (see range "b" in FIG. 7), as the end edge of the frame 6' is not transparent. Swimming safety is thus low. The lens 1' may be disengaged from the frame 6' if the swimming goggles is impinged by external force such that sharp corners of the rigid lens 1' might cause injury to the user. The eyes of the user might be injured if the lens 1' breaks. A further drawback of the swimming goggles resides in that the lenses 1', the padding members 2', the bridge 3', and the strap 4' are made of different material and thus cause difficulty in recycling. The glue for bonding the frame 6' and the lens 5' requires additional treatment when recycling.

The present invention is intended to provide a pair of swimming goggles that mitigates and/or obviate the above problems.

SUMMARY OF THE INVENTION

It is a primary object of the present invention to provide a pair of swimming goggles that is integrally formed to provide improved waterproof effect and safety.

A pair of swimming goggles in accordance with the present invention comprises two lenses, two padding members, a bridge, and a strap. The lenses, the padding members, and the bridge are integrally formed by a material that is transparent and flexible. Each lens is formed with an end edge and a front face that are resistant to stretching. A connecting section is formed on the end edge of each lens for connecting with an end of the strap. Each padding member is annular and directly formed on an inner side of an associated lens. Each padding member has a thickness smaller than that of the front face of the associated lens and that of the end edge of the associated lens to provide resiliency.

Each padding member includes a resilient extension with flexibility and a flange to be in close contact with an eye socket of the user.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
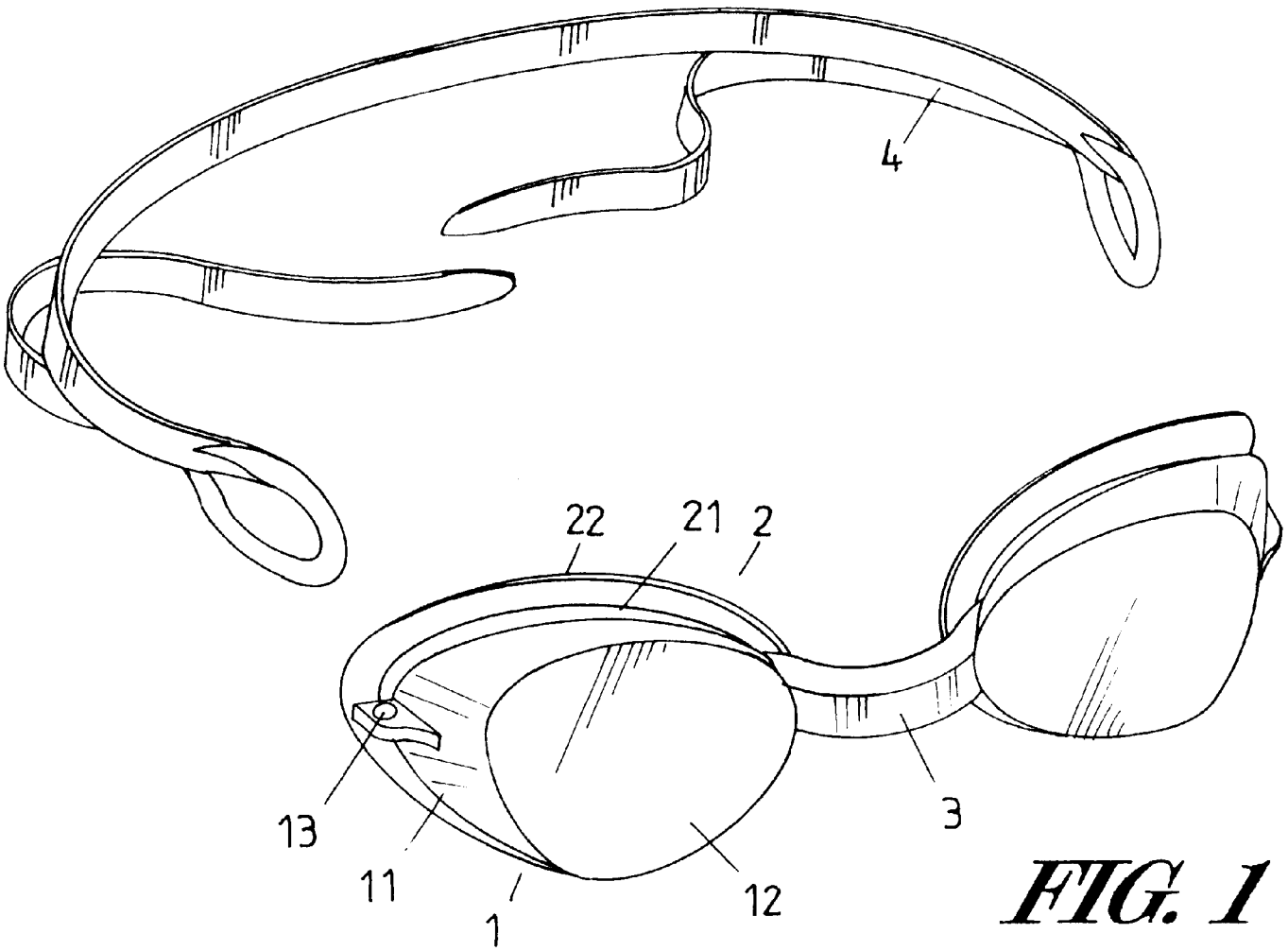
FIG. 1 is an exploded perspective view of a pair of swimming goggles in accordance with the present invention.
Figure 2:
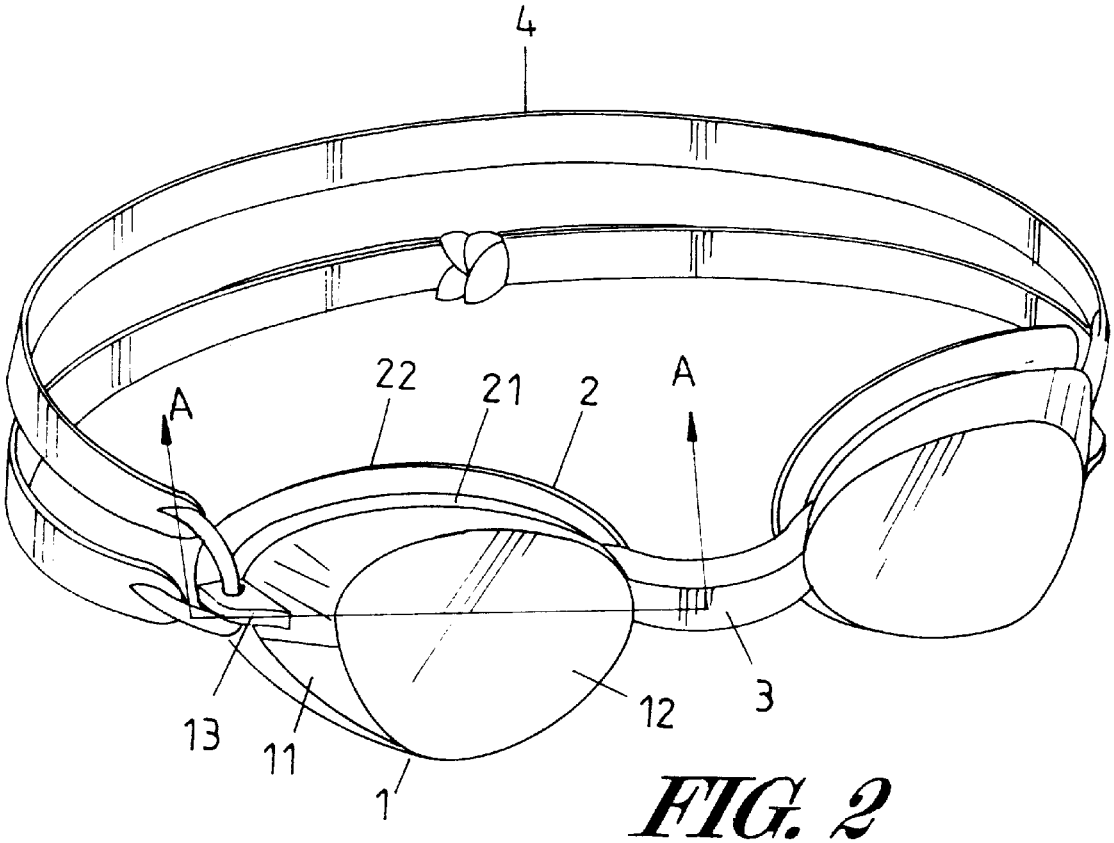
FIG. 2 is a perspective view of the pair of swimming goggles in accordance with the present invention.
Figure 3:
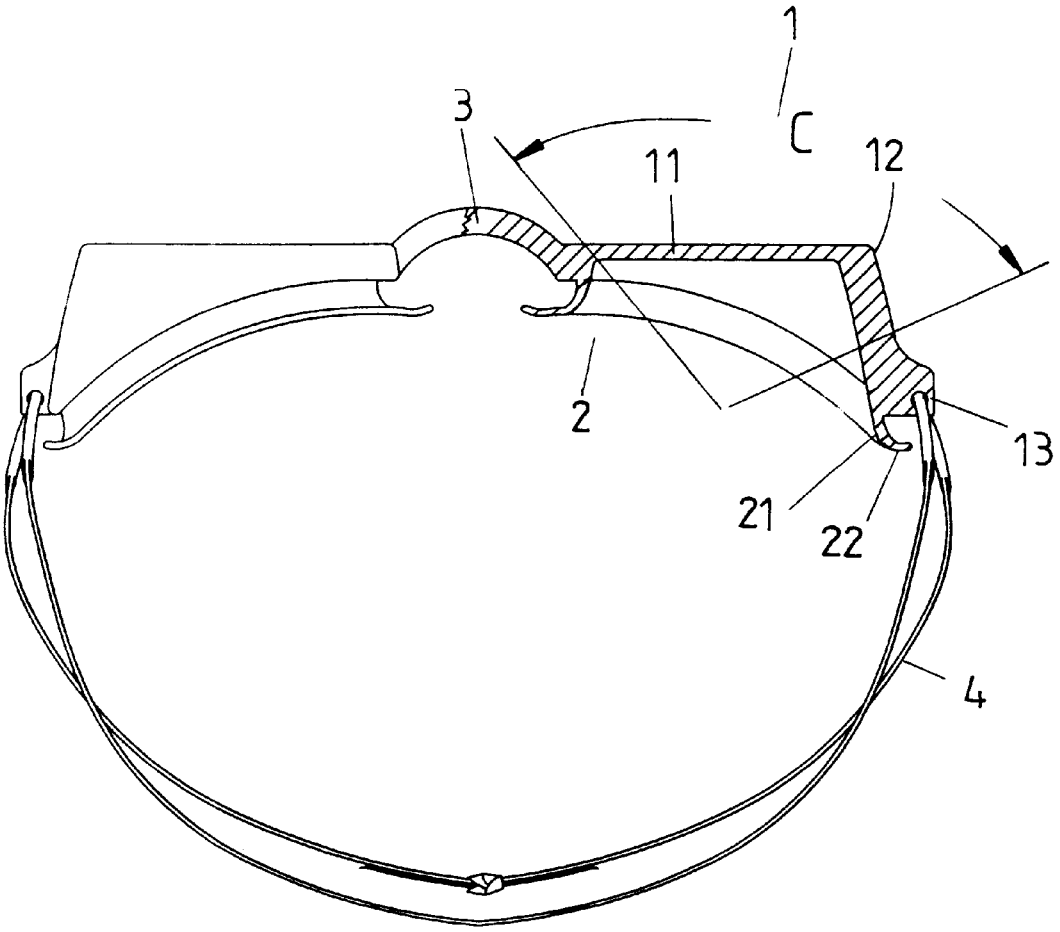
FIG. 3 is a top view, partly sectioned along line A—A in FIG. 2, of the pair of swimming goggles in accordance with the present invention.
Figure 4:
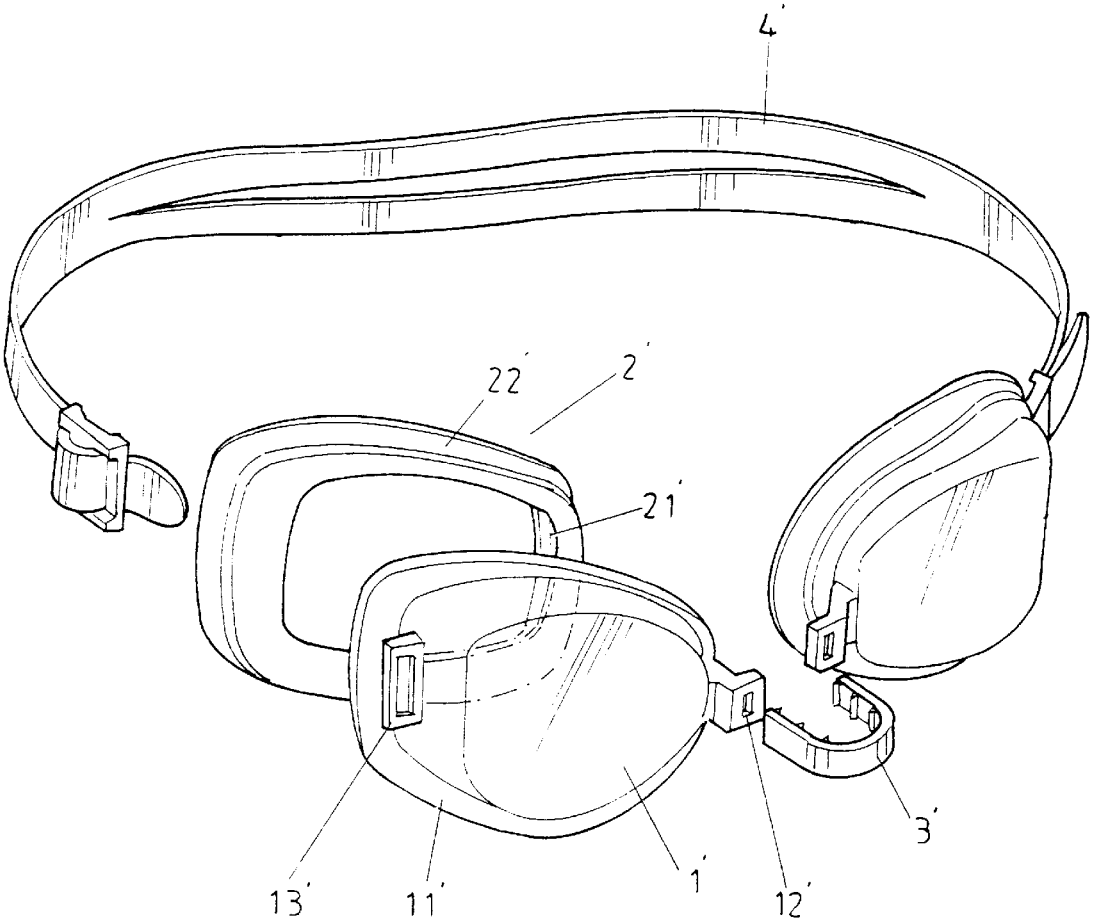
FIG. 4 PRIOR ART
FIG. 4 is a perspective view, partly exploded, of a pair of conventional swimming goggles.
Figure 5:
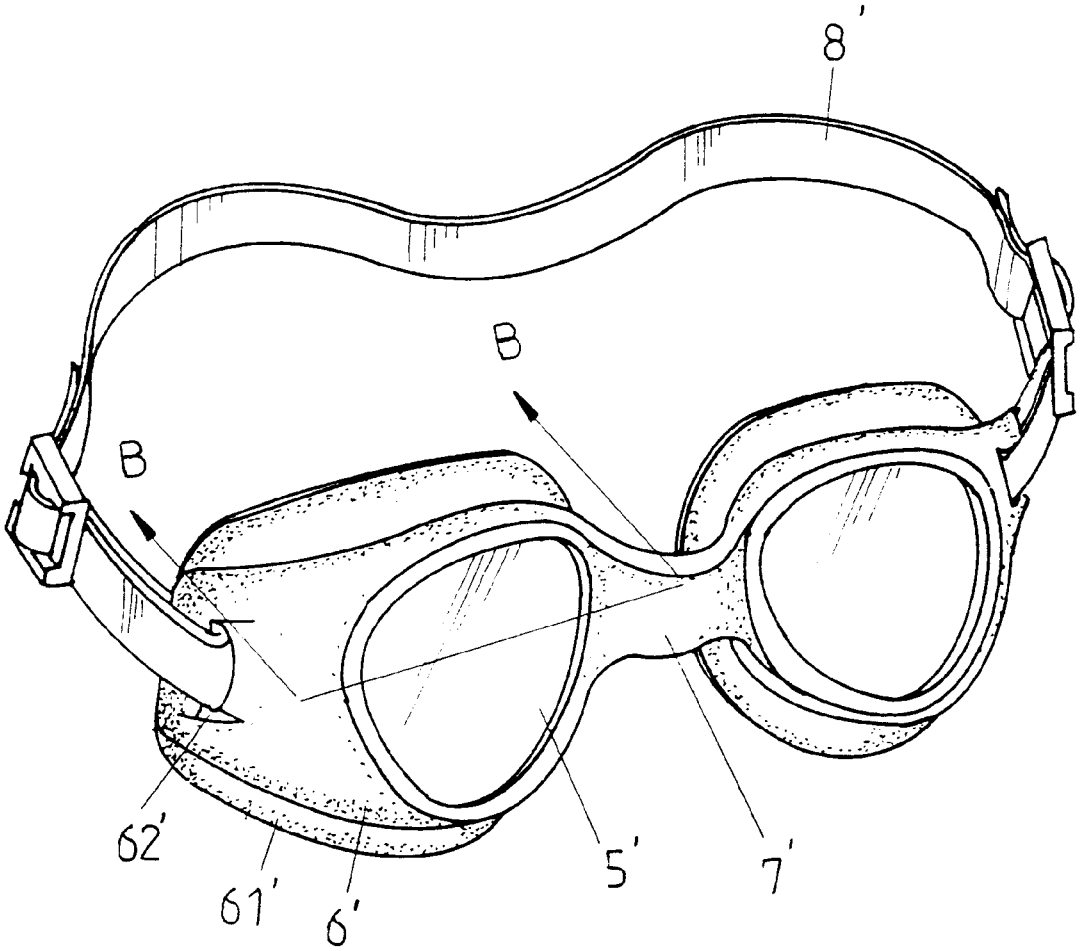
FIG. 5 PRIOR ART
FIG. 5 is a perspective view of the pair of swimming goggles in FIG. 4.
Figure 6:
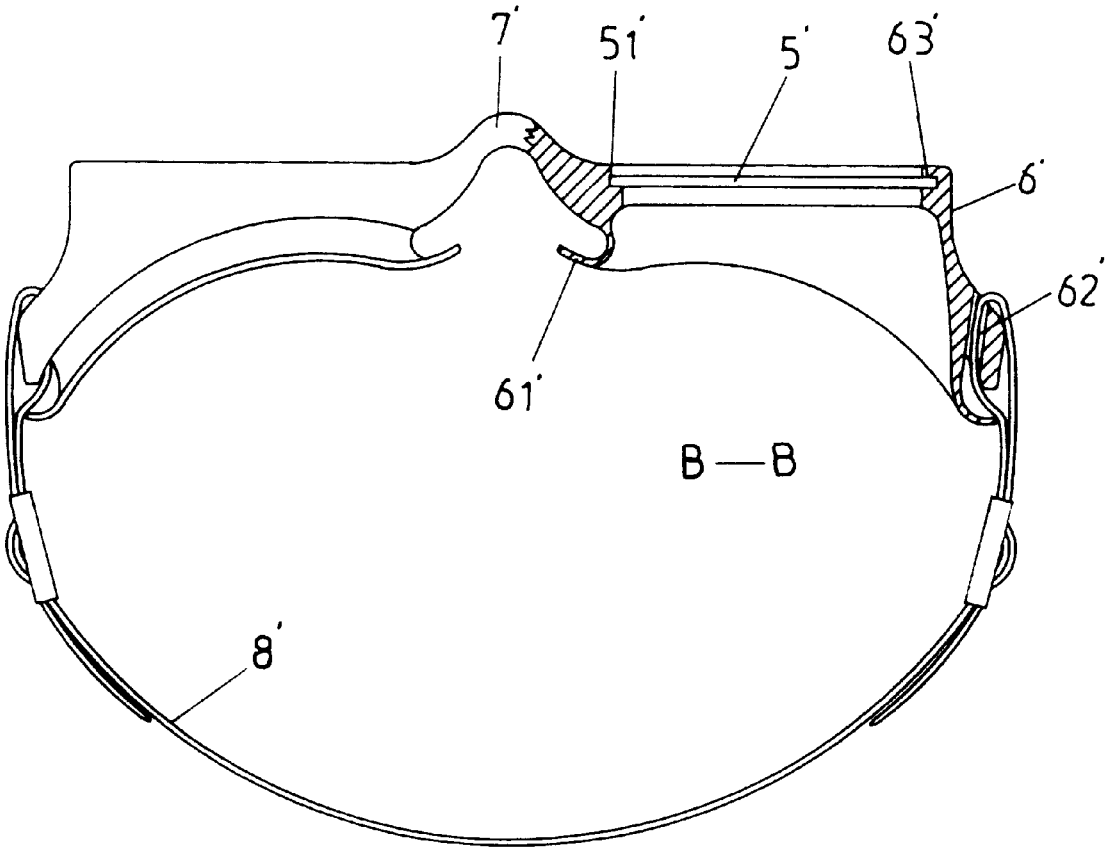
FIG. 6 PRIOR ART
FIG. 6 is a top view, partly sectioned along line B—B in FIG. 5, of the pair of swimming goggles in FIG. 5.
Figures 7, 8:
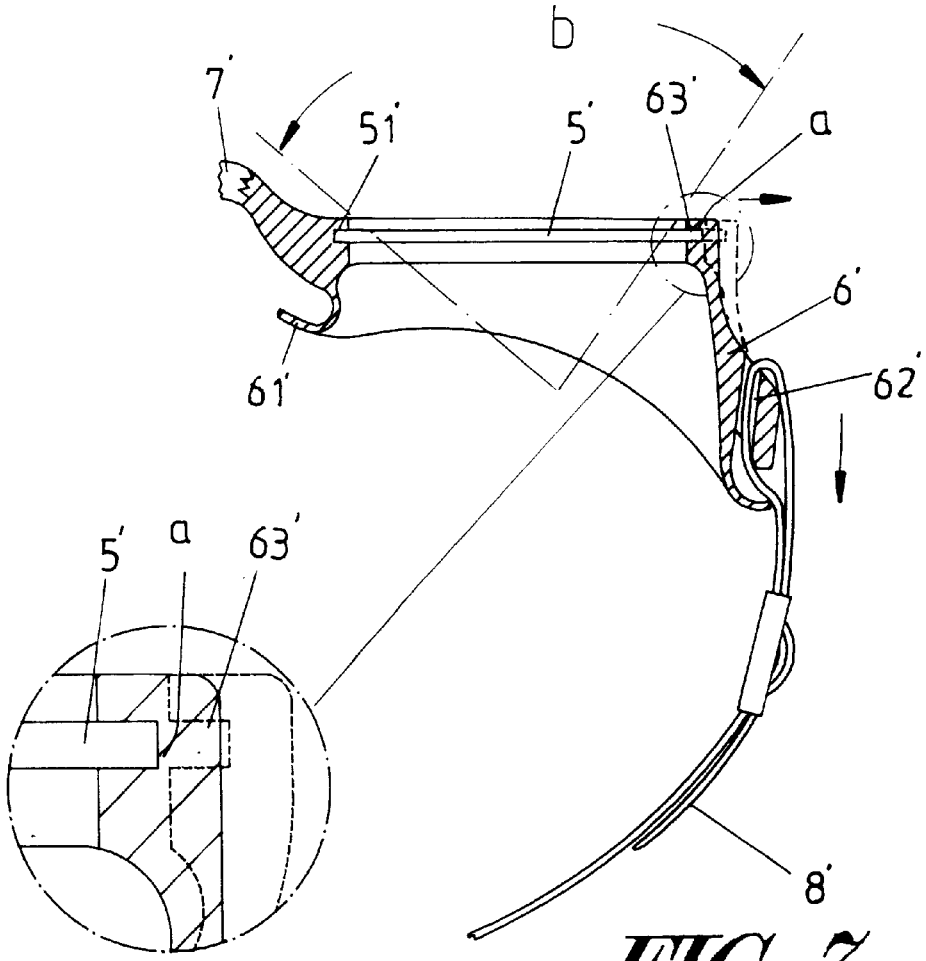
FIG. 8 PRIOR ART
FIG. 7 PRIOR ART
FIG. 7 is a partial sectional view of the pair of swimming goggles in FIG. 5.
FIG. 8 is an enlarged view of a circle in FIG. 7.

Referring to FIGS. 1 through 3, a pair of swimming goggles in accordance with the present invention generally includes two lenses 1, two padding members 2, a bridge 3, and a strap 4. The lenses 1, padding members 2, and bridge 3 are integrally formed by the same material that is transparent and slightly flexible. Each lens 1 is formed with an end edge 11 having an appropriate height. The end edge 11 and the front face 12 of the lens 1 are formed to provide a certain stretching-resistance. A connecting section 13 is formed on the end edge 11 for connecting with an end of the strap 4. Each padding member 2 is annular and directly formed on an inner side of an associated lens 1. Each padding member 2 is of a thickness smaller than that of the front face 12 and that of the end edge 11 of the lens 1 to provide certain resiliency. Each padding member 2 is formed with a resilient extension 21 having certain flexibility and a flange 22 to be in close contact with an eye socket of the user.

Referring to FIGS. 2 and 3, assembly of the pair of swimming goggle is extremely easy, i.e., only assembly of the strap 4 to the integrally formed main structure is required. When in use, the padding members 2 are in close contact with the eyes of the user. In addition, flexibility of the padding members 2 allows the flanges 22 to deform to comply with contours of the eye sockets of the user, thereby providing a reliable waterproof effect. The end edge 11 and the front face 12 of each lens 1 are thicker than the associated padding member 2 and thus have a better stretch-resistant effect than the latter. Namely, deformation of the end edge 11 and the front face 12 of each lens 1 is prevented during pulling of the strap 4. The view of the user wearing the pair of swimming goggles is good (see range "c" in FIG. 3), as the end edge 11 and the front face 12 of each lens 1 are transparent. Swimming safety is thus improved. Recycling of the pair of swimming goggle is easy, as the lenses 1, the padding members 2, and the bridge 3 are made of the same material. A further advantage of the pair of swimming goggle in accordance with the invention resides in that the lens 1 is flexible and thus less likely to cause injury to the user.

Although the invention has been explained in relation to its preferred embodiment, it is to be understood that many other possible modifications and variations can be made without departing from the spirit and scope of the invention as hereinafter claimed.

What is claimed is:

1. A pair of swimming goggles comprising two lenses, two padding members, a bridge, and a strap, the lenses, the padding members, and the bridge being integrally formed by a material that is transparent and flexible, each said lens being formed with an end edge and a front face that are resistant to stretching, a connecting section being formed on the end edge of each said lens for connecting with an end of the strap, each said padding member being annular and directly formed on an inner side of an associated said lens, each said padding member having a thickness smaller than that of the front face of the associated lens and that of the end edge of the associated lens to provide resiliency.

2. The pair of swimming goggles as claimed in claim 1, wherein each said padding member includes a resilient extension with flexibility and a flange adapted to be in close contact with an eye socket of the user.

3. A method for forming a pair of swim goggles comprising the steps of:

preparing a transparent and flexible material;

integrally forming a pair of lenses and a bridge section of said transparent and flexible material, said lenses each having an end edge, a front face, a connecting section, formed on said end edge of each of said lenses, and a pair of padding members;

forming a strap member; and attaching said strap member to said connecting section.

* * * * *